US008952675B2

(12) United States Patent
Fort et al.

(10) Patent No.: US 8,952,675 B2
(45) **Date of Patent: *Feb. 10, 2015**

(54) DEVICE FOR GENERATING AN ADJUSTABLE BANDGAP REFERENCE VOLTAGE WITH LARGE POWER SUPPLY REJECTION RATE

(75) Inventors: Jimmy Fort, Poyloubier (FR); Thierry Soude, Marseilles (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 328 days.

This patent is subject to a terminal disclaimer.

(21) Appl. No.: 13/472,750

(22) Filed: May 16, 2012

(65) Prior Publication Data

US 2012/0293149 A1 Nov. 22, 2012

(30) Foreign Application Priority Data

May 17, 2011 (FR) ..... 11 54266

(51) Int. Cl.
*G05F 3/16* (2006.01)
*G05F 3/20* (2006.01)
*G05F 3/30* (2006.01)

(52) U.S. Cl.
CPC ..... *G05F 3/30* (2013.01)
USPC ..... 323/316; 323/313; 323/314; 323/315; 327/539

(58) Field of Classification Search
CPC ..... G05F 3/30
USPC ..... 323/313–316; 327/538–544
See application file for complete search history.

(56) References Cited

U.S. PATENT DOCUMENTS 5,559,425 A * 9/1996 Allman ..... 323/315
6,002,243 A * 12/1999 Marshall ..... 323/313
6,002,244 A * 12/1999 Wrathall ..... 323/315
6,016,051 A * 1/2000 Can ..... 323/315

(Continued)

FOREIGN PATENT DOCUMENTS

EP 0895147 A1 2/1999

OTHER PUBLICATIONS

Banba, H. et al., "A CMOS Bandgap Reference Circuit with Sub-1-V Operation," IEEE Journal of Solid-State Circuits, vol. 34, No. 5, May 1999, 5 pp.

(Continued)

*Primary Examiner* — Timothy J Dole
*Assistant Examiner* — Yusef Ahmed
(74) *Attorney, Agent, or Firm* — Slater & Matsil, L.L.P.

(57) ABSTRACT

An adjustable bandgap reference voltage includes a first circuit for generating IPTAT, a second circuit for generating ICTAT, and an output module configured to generate the reference voltage. The first circuit includes a first amplifier connected to terminals of a core for equalizing voltages across the terminals, where the first amplifier has a first stage that is biased by the current inversely proportional to absolute temperature and is arranged according to a folded setup with first PMOS transistors arranged according to a common-gate setup. The first circuit also includes a feedback stage with an input connected to the first amplifier output. The feedback stage output is connected to the first stage input and to a terminal of the core. The second circuit includes a follower amplifier connected to a terminal of the core and separated from the first amplifier and the output module is connected to the feedback stage.

16 Claims, 5 Drawing Sheets

(56) References Cited

U.S. PATENT DOCUMENTS

| | | | | |
|---|---|---|---|---|
| 6,799,889 | B2 * | 10/2004 | Pennock | 374/178 |
| 7,199,646 | B1 * | 4/2007 | Zupcau et al. | 327/539 |
| 7,236,048 | B1 * | 6/2007 | Holloway et al. | 327/539 |
| 7,944,271 | B2 * | 5/2011 | Illegems | 327/513 |
| 8,456,235 | B2 * | 6/2013 | Tachibana et al. | 330/253 |
| 8,558,530 | B2 * | 10/2013 | Pulijala et al. | 323/314 |
| 2005/0077954 | A1 * | 4/2005 | Illegems | 327/541 |
| 2006/0197584 | A1 * | 9/2006 | Hsu | 327/539 |
| 2006/0261882 | A1 * | 11/2006 | Johnson | 327/539 |
| 2006/0268629 | A1 * | 11/2006 | Senouci et al. | 365/189.09 |
| 2007/0076483 | A1 | 4/2007 | Colman | |
| 2008/0061863 | A1 * | 3/2008 | De Barros Soldera et al. | 327/512 |
| 2009/0243708 | A1 * | 10/2009 | Marinca | 327/539 |
| 2009/0243711 | A1 * | 10/2009 | Marinca | 327/541 |
| 2009/0243713 | A1 * | 10/2009 | Marinca | 327/542 |
| 2009/0295360 | A1 * | 12/2009 | Hellums | 323/315 |
| 2010/0007324 | A1 * | 1/2010 | Masson et al. | 323/313 |
| 2010/0073070 | A1 * | 3/2010 | Ng et al. | 327/513 |
| 2010/0164608 | A1 * | 7/2010 | Shin | 327/539 |
| 2010/0225384 | A1 * | 9/2010 | Hirose et al. | 327/543 |
| 2011/0267133 | A1 * | 11/2011 | Kumar | 327/512 |
| 2012/0293143 | A1 | 11/2012 | Fort et al. | |

OTHER PUBLICATIONS

Isikhan, T. et al., "A New Low Voltage Bandgap Reference Technology," IEEE 2009, pp. 183-186.

Lam, Y. et al., "CMOS Bandgap References with Self-Biased Symmetrically Matched Current-Voltage Mirror and Extension of Sub-1-V Design," IEEE Transactions on Very Large Scale Integration (VLSB Systems) vol. 18, No. 6, Jun. 2010, pp. 857-865.

Gray, P., "Analysis and Design of Analog Integrated Circuits," Fifth Edition, International Student Version, Feb. 15, 2001, 9 pp.

Ker, M., et al., "A CMOS Bandgap Reference Circuit for Sub-1-V Operation Without Using Extra Low-Threshold-Voltage Device," 2004 IEEE International Symposium on Circuits and Systems, May 23-26, 2004, pp. 41-44.

* cited by examiner

DEVICE FOR GENERATING AN ADJUSTABLE BANDGAP REFERENCE VOLTAGE WITH LARGE POWER SUPPLY REJECTION RATE

CROSS-REFERENCE TO RELATED APPLICATIONS

This application claims the priority benefit of French patent application number 1154266, filed May 17, 2011, entitled "Low Voltage Bandwith Improved Power Supply Rejection," which is hereby incorporated by reference to the maximum extent allowable by law.

TECHNICAL FIELD

The invention relates to the generation of a so-called bandgap reference voltage. A bandgap reference voltage is a voltage which is substantially independent of temperature, and devices generating such reference voltages are widely used in integrated circuits.

BACKGROUND

Generally, a circuit generating a bandgap voltage delivers an output voltage in the vicinity of 1.25 volts, near the bandgap value of silicon at the temperature of 0 degrees Kelvin which is equal to 1.22 eV. In certain circuits, the value of the reference voltage delivered may be adjusted by the value of a resistor or a resistance ratio. One then speaks of an adjustable bandgap reference voltage.

In a general manner, the voltage difference between two PN junctions, for example diodes or bipolar transistors mounted in diode fashion, exhibiting different current densities, makes it possible to generate a current proportional to absolute temperature, generally known by the person skilled in the art by the name "PTAT Current", where the acronym PTAT stands for "Proportional To Absolute Temperature".

Moreover, the voltage across the terminals of a diode or of a transistor mounted in diode fashion traversed by a current such as a PTAT current, is a voltage comprising a term inversely proportional to absolute temperature and a second-order term, that is to say varying non-linearly with absolute temperature. Such a voltage is nonetheless designated by the person skilled in the art by the term voltage inversely proportional to absolute temperature and is generally known by the person skilled in the art by the name "CTAT voltage", where the acronym CTAT stands for "Complementary To Absolute Temperature". It is then possible to obtain a CTAT current on the basis of this CTAT voltage.

The so-called bandgap reference voltage may then be obtained on the basis of the sum of these two currents through an appropriate choice of the resistors in which these two currents flow, making it possible to cancel the contribution of the temperature factor for a given temperature, so as to render this so-called bandgap voltage independent of the temperature around the given temperature.

An exemplary circuit generating a bandgap reference voltage is described for example in the article by Hironori Banba et al., entitled "A CMOS Bandgap Reference Circuit with Sub-1-V Operation", IEEE Journal of Solid-State Circuits, Vol. 34, No. 5, May 1999, the relevant teaching of which are incorporated herein by reference.

Such a circuit comprises means for equalizing the voltages across the terminals of a core, comprising a resistor and, in the two branches of the core, two different numbers of diodes, the core then being traversed by an internal current proportional to absolute temperature (PTAT current).

Lateral resistors are moreover connected between the terminals of the core and earth, and are then traversed by a current inversely proportional to absolute temperature (Ictat current). An output module is then designed to generate the bandgap output reference voltage.

The operation of the circuit with very low current consumption requires the use of a large resistive value for the lateral resistor generating the current, typically several megaohms. Moreover this resistor must be duplicated at each terminal of the core so as to balance the currents. This consequently results in a considerable occupied silicon area.

Another type of circuit delivering a bandgap voltage reference is described in the work by P. R. Gray, P. H. Hurst, S. H. Lewis and R. G. Meyer, entitled "Analysis and Design of Analog Integrated Circuits", $4^{th}$ edition, New York: Wiley, Chapter 4, pp. 326-327, the relevant teach of which is incorporated herein by reference. This circuit uses, in particular, cascoded current mirrors disposed between the power supply voltage and the branches of the core, so as to improve the power supply rejection rate. The PTAT current delivered by the core then flows in an additional lateral branch comprising a resistor connected in series with an additional bipolar transistor mounted as an additional diode. This consequently results, across the terminals of this additional resistor, in a potential difference proportional to absolute temperature.

Moreover, the resulting voltage across the terminals of the additional resistor-additional diode assembly is the sum of this voltage proportional to absolute temperature and of the emitter low voltage of the additional bipolar transistor which is, itself, inversely proportional to absolute temperature. An output module makes it possible to deliver a bandgap reference voltage as output.

However, such a circuit exhibits the drawback of requiring a relatively high power supply voltage because of the presence of cascoded current mirrors, stacked between the power supply terminal and the core.

SUMMARY OF THE INVENTION

In one aspect, embodiments of the present invention provide for a device for generating an adjustable bandgap reference voltage. The device includes first means for generating a current proportional to absolute temperature comprising first processing means connected to the terminals of a core and designed to equalize the voltages across the terminals of the core. The device further includes second means for generating a current inversely proportional to absolute temperature connected to the core. The device further includes an output module designed to generate the reference voltage. The first processing means comprise a first amplifier possessing at least one first stage, biased on the basis of the current inversely proportional to absolute temperature, arranged according to a folded setup and comprising first PMOS transistors arranged according to a common-gate setup, and a feedback stage whose input is connected to the output of the amplifier and whose output is connected to the input of the first stage as well as to at least one terminal of the core. The second generating means comprise a follower amplifier setup connected to a terminal of the core and separated from the first amplifier. The output module is connected to the feedback stage.

In another aspect, embodiments of the present invention provide for an integrated circuit having a power voltage terminal, a ground terminal, and an adjustable bandgap reference voltage generator, coupled between the power voltage terminal and the ground terminal. The adjustable bandgap reference voltage generator includes a core circuit, and a first circuit configured to generate a current proportional to absolute temperature, the first circuit configured to equalize voltages across the terminals of the core circuit, the first circuit including a first amplifier possessing at least one first stage, biased in response to a current inversely proportional to absolute temperature, the at least one first stage arranged according to a folded setup and comprising first PMOS transistors arranged according to a common-gate setup, and a feedback stage having an input connected to an output of the first amplifier and having an output connected to an input of the first stage and to at least one terminal of the core. The generator further includes a second circuit configured to generate the current inversely proportional to absolute temperature, the second circuit comprising a follower amplifier connected to a terminal of the core and separated from the first amplifier. The generator further includes an output module, connected to the feedback stage, and configured to output the bandgap reference voltage.

BRIEF DESCRIPTION OF THE DRAWINGS

Other advantages and characteristics of the invention, making it possible in particular to improve the stability of the output signal while increasing the gain of the amplifier, will be apparent on examining the detailed description of wholly non-limiting embodiments and the appended drawings in which.

DETAILED DESCRIPTION OF ILLUSTRATIVE EMBODIMENTS

Figure 1:
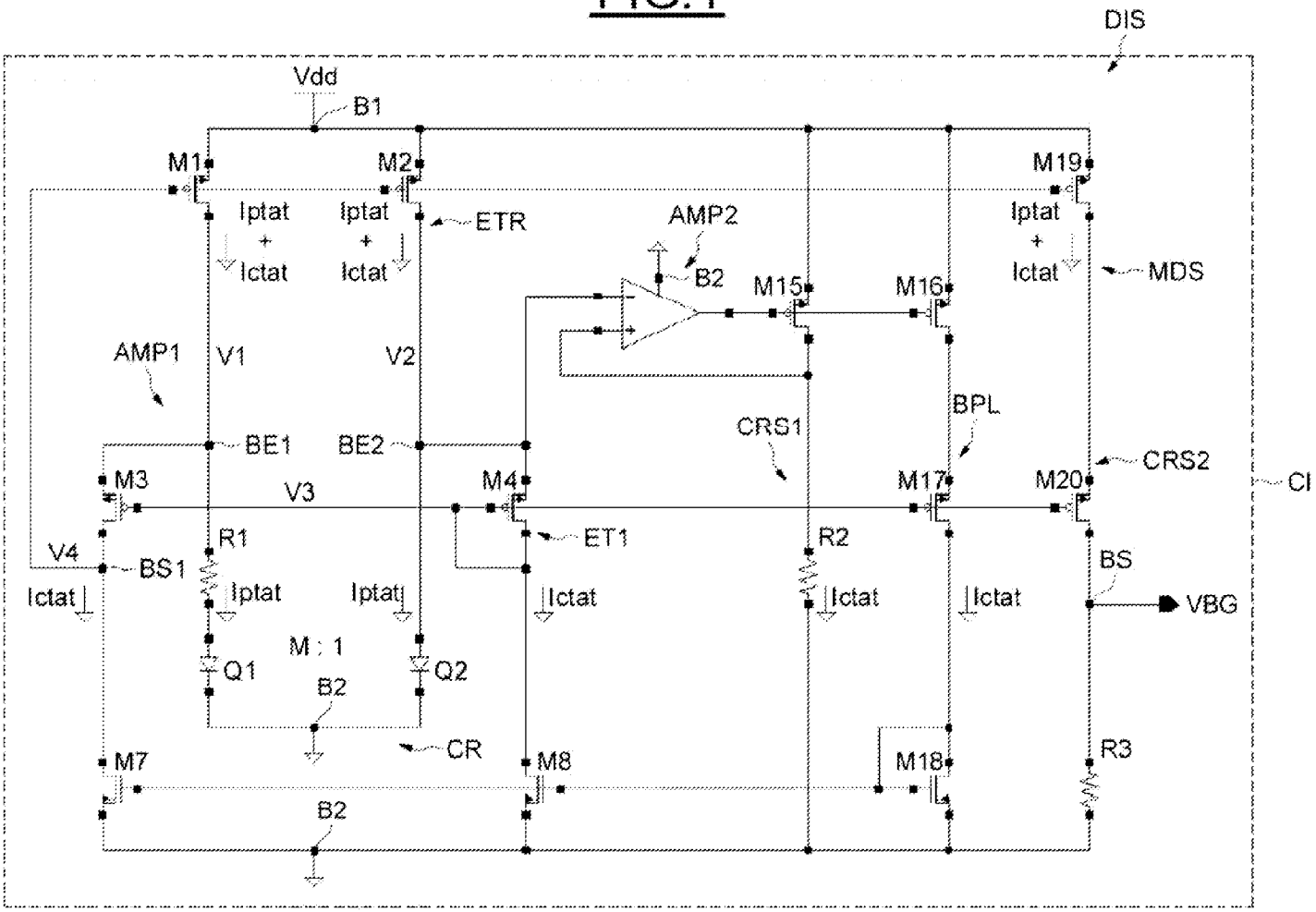
FIGS. 1 to 5 schematically illustrate various embodiments of a generating device according to the invention.

Before addressing the illustrated embodiments in detail, various embodiments and advantageous features thereof will be discussed generally in the following paragraphs.

According to one embodiment, there is proposed a generator of a reference voltage of the bandgap type capable of operating under a low power supply voltage, with a reduced silicon area, and exhibiting a large PSRR parameter ("Power Supply Rejection Ratio"). It is recalled that the PSRR parameter is the ratio of the variation of the power supply voltage to the corresponding variation of the bandgap voltage delivered.

According to one aspect, there is proposed a device for generating a bandgap reference voltage comprising first means for generating a current proportional to absolute temperature, these first generating means comprising first processing means connected to the terminals of a core and designed to equalize the voltages across the terminals of the core. The device also comprises second means for generating a current inversely proportional to absolute temperature, connected to the core, and an output module designed to generate the reference voltage.

Of course the person skilled in the art is aware that the character proportional to absolute temperature of the internal current flowing in the core depends in particular on the proper equalization of the voltages across the terminals of the core, this equalization possibly being better or worse as a function in particular of the technological vagaries related to the method of manufacture of the components possibly leading to mismatches of transistors, for example, or else of internal offsets in voltages.

A current proportional to absolute temperature is therefore understood here as a current proportional or substantially proportional to absolute temperature, especially taking account of technological inaccuracies and/or of possible voltage offsets for example.

Likewise, a CTAT current is a current inversely proportional to absolute temperature or substantially inversely proportional to absolute temperature, especially taking account likewise of technological inaccuracies.

According to a general characteristic of this aspect, the first processing means comprise a first amplifier possessing at least one first stage, biased on the basis of the current inversely proportional to absolute temperature, arranged according to a folded setup and comprising first PMOS transistors arranged according to a common-gate setup. The first processing means also comprise a feedback stage whose input is connected to the output of the amplifier and whose output is connected to the input of the first stage as well as to at least one terminal of the core. The second generating means comprise, for their part, a follower amplifier setup, connected to a terminal of the core and separated from the first amplifier, and the output module is connected to the feedback stage.

Thus, according to this aspect, the voltage inversely proportional to absolute temperature available at a terminal of the core is recovered through the follower amplifier setup, and the first stage of the first amplifier arranged in folded mode is biased on the basis of the corresponding current which is inversely proportional to absolute temperature, thereby allowing the flow, in the feedback stage of the first amplifier, of a current equal to the sum of the current proportional to absolute temperature and of the current inversely proportional to absolute temperature.

Therefore, through this structure, the use of duplicate considerable lateral resistors is avoided, thereby allowing a saving of space while offering very low current consumption since, in addition to the economy of resistance, the branches of the first stage which divert the Ictat current also serve as amplifier.

The common-gate setup (in which the input signal drives the source of a MOS transistor) which is distinguished from a common-source setup (in which the signal drives a gate of a MOS transistor) makes it possible to decrease the input impedance since a source instead of a gate is driven, thereby making it possible in particular to improve the PSRR parameter.

Moreover, a folded setup of the first stage of the amplifier, in which the branches containing the PMOS transistors are connected between the terminals of the core and a reference voltage, for example earth, is distinguished from a stacked setup in which the transistors of the first stage are stacked with the transistors of the feedback stage and the transistors of the core, and thus makes it possible to operate under a minimum power supply voltage equal to the sum of a drain-source voltage of a MOS transistor and of a diode voltage, i.e. about 0.9 volts. The use of PMOS transistors also allows a bias of the first stage "through the bottom", that is to say a flow of the bias current towards earth.

Furthermore, the use of PMOS transistors mounted in common gate fashion, which require for their operation a negative gate-source voltage Vgs, helps with being able to operate the device under the minimum voltage of the power supply mentioned hereinabove.

Although various types of architectures are possible, in particular a feedback connected to a single terminal of the core, it is preferable that the first amplifier be a differential-input single-output amplifier, and that the feedback stage be a single-input differential-output feedback stage. A differential-differential global architecture such as this makes it possible to have good equality between the currents flowing in the two transistors (diodes) of the core and therefore better linearity in relation to temperature of the current proportional to absolute temperature.

According to one embodiment, a bias loop is connected between the second means for generating the current inversely proportional to absolute temperature and the first stage of the first amplifier, this bias loop being designed to bias the first stage on the basis of the current inversely proportional to absolute temperature.

According to one embodiment, the first stage comprises at least one differential pair of branches connected between the two terminals of the core and a reference voltage, for example earth, and the bias loop is designed to cause the flow, in each differential pair of branches, of a bias current drawn from the current inversely proportional to absolute temperature, the intermediate current flowing in the feedback stage being the sum of the current proportional to absolute temperature and of each bias current flowing in each differential pair of branches.

According to one embodiment, the follower amplifier setup comprises a second amplifier and a feedback transistor connected between the output of the second amplifier and the input of the second amplifier. The second means for generating the current inversely proportional to absolute temperature furthermore comprise a first resistive circuit connected in series with the feedback transistor. The first stage comprises, within a differential pair of branches, a pair of NMOS bias transistors connected in series with a pair of first PMOS transistors. The bias loop comprises the feedback transistor, a first additional transistor forming with the feedback transistor first current-copying means, as well as the said pair of bias transistors. The bias loop is furthermore designed to cause the flow, in each differential pair of branches, of a bias current equal to the said current inversely proportional to absolute temperature, or to a fraction of this current inversely proportional to absolute temperature.

According to one embodiment, the feedback stage comprises a pair of second PMOS transistors mutually connected by their gates, the respective sources of the second transistors being connected to a power supply terminal, the drains of the second PMOS transistors being respectively linked to the two terminals of the core. The output module comprises a second resistive circuit comprising a second additional PMOS transistor forming, with the second PMOS transistors of the feedback stage, second copying means configured to deliver in the second resistive circuit a copied current equal to the said intermediate current flowing in the feedback stage or a multiple or sub-multiple of the said intermediate current.

According to another embodiment, the first amplifier comprises an inverter stage arranged in a setup of the common-source type, connected between the output of the first stage and the input of the feedback stage, the output of the inverter stage then forming the output of the amplifier.

The addition of such an inverter stage makes it possible in particular to increase the span of possible values for the power supply voltage, and to further improve the PSRR parameter especially if the gain is considerable.

According to another embodiment, the first stage of the amplifier comprises a first differential pair of branches connected between the two terminals of the core and a reference voltage, for example earth. This first differential pair of branches comprises a first pair of first PMOS transistors. A second differential pair of branches is connected in a crossed manner between the two terminals of the core and the reference voltage. This second differential pair of branches comprising a second pair of first PMOS transistors. The two doublets of homologous transistors of the two pairs form respectively two pseudo-current mirrors. The drains of the two first PMOS transistors of the second differential pair are respectively connected to the gates of two NMOS transistors of identical size and are traversed by one and the same current or by two substantially equal currents.

Such an embodiment makes it possible to reduce the voltage offset of the amplifier, thereby favouring the equalization of the voltages across the terminals of the core.

Turning now to the illustrated embodiments. In FIG. 1, the reference DIS designates a device for generating a bandgap voltage VBG. This device DIS is for example produced in a manner integrated within an integrated circuit CI.

The device DIS comprises a core CR designed so as, when the voltages V1 and V2 at its two terminals BE1 and BE2 are equalized, to be traversed by an internal current Iptat proportional to absolute temperature.

Here the core CR comprises a first PNP bipolar transistor, referenced Q1, mounted in diode fashion and connected in series with a resistor R1 between the input terminal BE1 and a terminal B2 linked to a reference voltage, here earth. The core CR also comprises a PNP bipolar transistor referenced Q2, also mounted in diode fashion, and connected in series between the second terminal BE2 of the core and the terminal B2 linked to earth.

The size of the transistor Q1 and the size of the transistor Q2 are different, and are in a ratio M in such a way that the density of current passing through the transistor Q1 is different from the density of current passing through the transistor Q2. Of course it would also be possible to use a transistor Q2 and M transistors Q1 in parallel, all of the same size as that of the transistor Q2.

As is well known by the person skilled in the art, when the voltages V1 and V2 are equal or substantially equal, the internal current Iptat passing through the resistor R1 is then proportional to absolute temperature and equal to KTLog (M)/qR1, where K denotes Boltzmann's constant, T the absolute temperature, q the charge of an electron, and Log the Napierian logarithm function. The device also comprises a first amplifier AMP1 here possessing a first stage ET1 arranged in common-gate setup and in folded setup.

The amplifier AMP1 is fed back by a feedback stage ETR connected between the output BS1 of the first stage ET1, and therefore of the amplifier AMP1, and the differential input BE1, BE2 of the first stage which also forms the two terminals of the core CR. The fed-back amplifier is thus designed to equalize the voltages V1, V2 at the terminals BE1, BE2 of the core CR.

The first stage ET1 of the amplifier AMP1, which here is a stage with differential input and single output, here comprises a differential pair of branches comprising a pair of PMOS transistors M3, M4 mutually connected by their gate.

These two PMOS transistors are in common-gate setup, their respective sources, receiving the input signal, being connected to the two input terminals BE1, BE2. The voltages across the terminals BE1, BE2 are of the order of 500 mV to 800 mV throughout the span of temperatures.

The transistor M4 is mounted in diode fashion, its drain being linked to its gate. The voltage V3 across the terminals of the gates of the transistors M3 and M4 is equal to V2 minus the gate-source voltage of M4. At the lowest it is equal to the drain-source saturation voltage of the transistor M8, i.e. of the order of 100 millivolts. The voltage Vgs across the terminals of the transistors M3 and M4 is consequently negative and compatible with the operation of a PMOS transistor.

The drain of the transistor M3 here forms the output terminal BS1 of the first stage ET1. The first stage ET1 also comprises two NMOS bias transistors, M7 and M8, mutually connected by their gate. The transistor M7 is connected in series between the drain of the transistor M3 and the terminal B2 linked to earth, and the transistor M8 is connected in series between the drain of the transistor M4 and the terminal B2.

The feedback stage ETR, arranged in common-source setup, comprises a pair of second PMOS transistors, M1, M2, mutually connected by their gate. The second PMOS transistor M1 has its source connected to the terminal B1 linked to a power supply voltage Vdd, and its drain connected to the terminal BE1. The second PMOS transistor M2 also has its source connected to the power supply terminal B1 and its drain connected to the terminal BE2 of the core. The voltage output terminal BS1 of the stage ET1 is connected to the input (gate of the transistors M1 and M2) of the stage ETR. The feedback stage is therefore here a single-input differential-output stage, thereby making it possible to obtain a completely differential global architecture.

The device DIS also comprises a separate follower amplifier setup distinct from the first amplifier AMP1 comprising a second operational amplifier AMP2 whose negative input is linked to the terminal BE2 of the core and whose output is linked to the gate of a PMOS feedback transistor M15. The source of this transistor M15 is linked to the first power supply terminal B1 and its drain is looped back to the positive input of the amplifier AMP2. The structure of the amplifier AMP2 is conventional and is for example the type with common source.

A first resistive circuit CRS1, here comprising a resistor R2, is connected in series between the drain of the feedback transistor M15 and earth (terminal B2).

The second amplifier AMP2 fed back by the feedback transistor M15, as well as the first resistive path CRS1, form second means for generating a current Ictat inversely proportional to absolute temperature.

The device DIS also comprises a bias loop BPL connected between the second generating means, and more particularly the gate of the feedback transistor M15, and the first stage ET1 of the first amplifier AMP1. The bias loop BPL here comprises the feedback transistor M15, as well as a first additional transistor M16 whose gate is connected to the gate of the feedback transistor M15.

The source of the transistor M16 is connected to the power supply terminal B1, the size (channel width W/channel length L) of each of the transistors M15 and M16 is identical so that the transistors M15 and M16 form first current-copying means, so that the current passing through the transistor M16 is equal to the current passing through the transistor M15.

In addition to a transistor M17, the function of which will be returned to in greater detail hereinafter, the bias loop also comprises a current mirror formed by the two bias transistors M7, M8 and by a transistor M18 mounted in diode fashion and connected in series between the transistor M17 and the terminal B2 linked to earth.

The device DIS also comprises an output module MDS here comprising second current-copying means formed by the PMOS transistors M1, M2 of the feedback stage, and by a second PMOS additional transistor, referenced M19. The gate of this transistor M19 is connected to the gate of the transistors M1, M2 and its source is linked to the power supply terminal B1. Its drain is linked to the output terminal BS of the device by way of a transistor M20, the function of which will be returned to in greater detail hereinafter.

Although the ratio of the size of the transistor M19 to the size of the transistors M1, M2 may be arbitrary, the size of the transistor M19 is here taken equal to the size of the transistor M2 (equal to the size of the transistor M1) in such a way that the second copying means M1, M2, M19 deliver a copied current equal to the intermediate current flowing in the feedback stage.

The output module MDS also comprises a second resistive path CRS2 comprising a resistor R3 here connected between the output terminal BS and earth (terminal B2).

In the steady state, that is to say when the voltages V1 and V2 are equalized or almost equalized, the core CR is traversed by the internal current Iptat. Moreover, the voltage V2 available at the terminal BE2 of the core is a CTAT voltage, that is to say a voltage inversely proportional to absolute temperature.

The second amplifier AMP2, fed back by the feedback transistor M15, equalizes the voltages present at these two inputs with the value of the voltage V2. Consequently, the current passing through the feedback transistor M15 and consequently the resistor R2 of the first resistive path CRS1, is the current inversely proportional to absolute temperature Ictat=V2/R2. This current is copied in the branch M16, M17, M18 of the bias loop BPL by way of the current mirror formed by the transistors M15 and M16. This current is moreover copied in the branches of the differential pair of the first stage ET1 of the first amplifier AMP1 by way of the transistors M7, M8, M18, of the same size, and which consequently form a current mirror.

Consequently, the intermediate current which flows in the feedback stage ETR of the first amplifier AMP1, that is to say through the transistors M1 and M2, is, on account of the folded setup of the first stage, the sum of the current Iptat flowing in the core CR and of the current Ictat.

This intermediate current Iptat+Ictat is equal to $$\frac{kT\mathrm{Log}M}{qR1}+\frac{V2}{R2},$$

This intermediate current is thereafter copied in the second resistive layout CRS2 of the output module MDS by the current-copying means formed by the transistors M1, M2 and M19, all three of which are, in this embodiment, the same size.

Consequently, this copied current is here equal to the intermediate current flowing in the feedback stage.

Because of the presence of the resistor R3, the output voltage VBG is equal to $$\frac{R3}{R2}\left(V2+\frac{R2kT}{R1q}\mathrm{Log}M\right).$$

By correctly choosing the ratio R2/R1, the temperature dependent coefficient of the voltage VBG may be zeroed for a given temperature, for example 27° C., and the value of the voltage VBG is then considered to be independent of absolute temperature for this given temperature, that is to say it will vary very little in a span of temperatures around this given temperature. The value of the resistor R3 makes it possible to adjust the value of the voltage VBG.

Although not indispensable, the auxiliary transistors M17 and M20, whose gates are connected to the gates of the transistors M3 and M4 of the first stage ET1 of the first amplifier, form respectively, with the transistors M16 and M19, two cascode setups. The presence of the first cascode transistor M17 makes it possible to obtain good equality between the drain voltage of the transistor M16 and the voltage present at the positive input of the second amplifier AMP2, thereby guaranteeing very good copying of current at the level of M15-M16.

The PSRR parameter of the output voltage VBG depends on the power supply rejection at the level of the resistive path CRS2 and the power supply rejection of the intermediate current Iptat+Ictat flowing in the feedback stage ETR.

The power supply rejection in the resistive path CRS2 is improved by the addition of the cascode transistor M20.

On account of the cascode transistor M14, generally R3 is chosen so as to be able to obtain a value of the voltage VBG which is strictly less than the minimum of the voltage V2 over the temperature span. If the cascode transistor M20 is removed, it is possible to choose R3 so as to be able to obtain a value of the voltage VBG which is higher (up to Vdd–VDSSAT where VDSSAT designates the drain-source saturation voltage of the transistor M19), but at the price of a deterioration in the PSRR parameter.

The power supply rejection of the intermediate current is also improved by the fact that the PMOS transistors of the stage ET1 are arranged in a common-gate setup. Indeed, the impedance at the terminals BE1 and BE2 is then significantly reduced, thereby making it possible to increase the PSRR parameter.

Moreover, the feedback divides this impedance by a factor equal to 1 plus the open-loop gain, thereby further improving the PSRR parameter.

Figure 2:
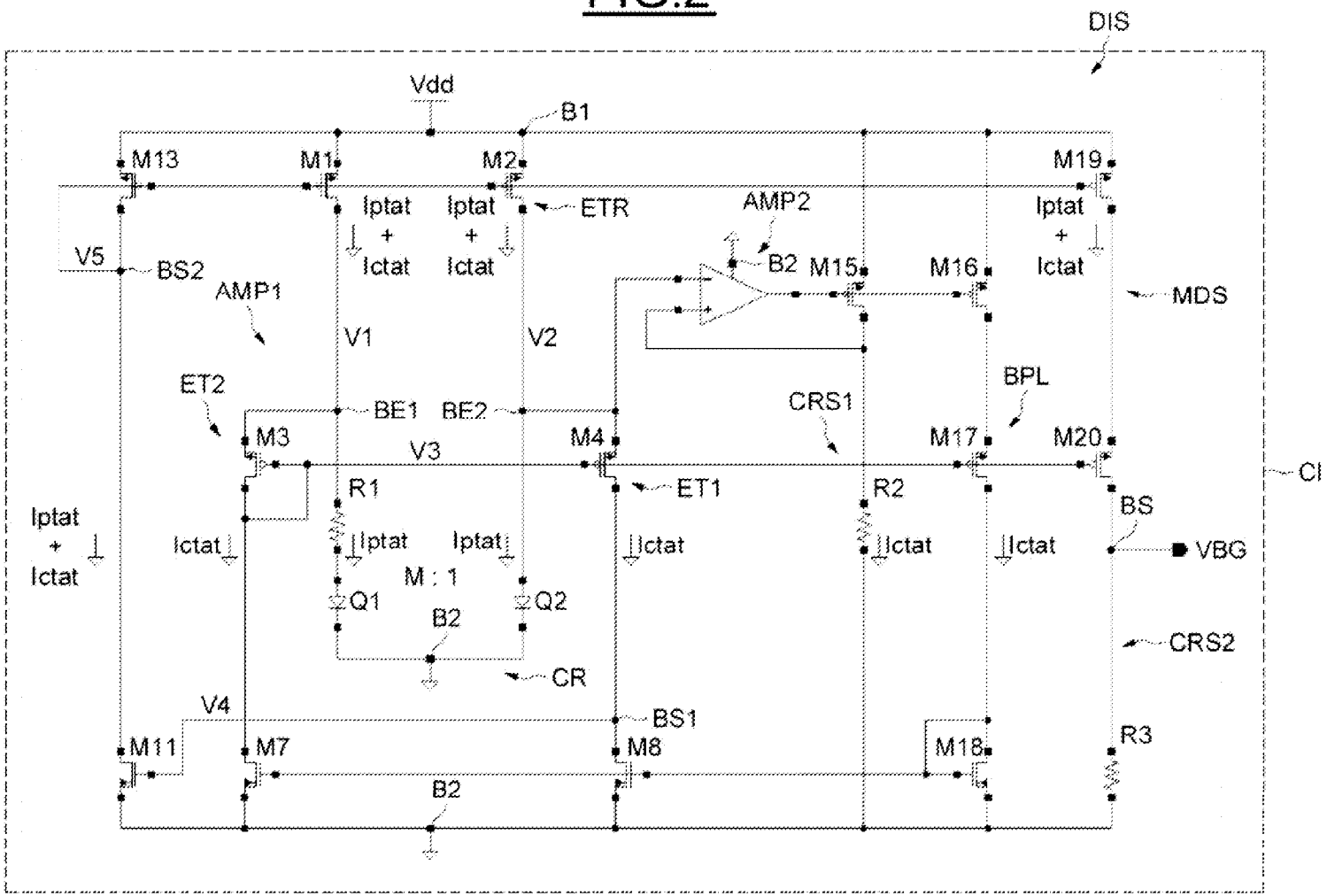

So as to increase the span of possible values for the power supply voltage Vdd, and to further increase the PSRR rate, it is possible to use the embodiment of the device DIS illustrated in FIG. 2.

Relative to the embodiment of FIG. 1, the amplifier AMP1 of the device DIS here comprises an inverter stage ET2 arranged in a setup of the common-source type (the output signal of the first stage drives the gate of a MOS transistor), this inverter stage being connected between the output BS1 of the first stage ET1 and the input of the feedback stage, the output BS2 of the inverter stage forming the output of the amplifier AMP1.

In this embodiment, this time it is the first PMOS transistor M3 which is mounted in diode fashion, and the output BS1 of the first stage is formed by the drain of the first PMOS transistor M4.

The inverter stage ET2 here comprises a first NMOS transistor M11 as well as a PMOS transistor M13. The source of the NMOS transistor M11 is linked to the reference terminal B2 (earth) while the source of the PMOS transistor M13 is linked to the power supply terminal B1.

The drains of the transistors M11 and M13 are linked together and form the output BS2 of the inverter stage ET2. This output BS2 is linked to the gate of the transistors M1, M2, M13 and M19.

It is noted here moreover that the transistor M13 is mounted in diode fashion, thereby conferring a relatively low gain on the inverter stage ET2.

That said, the span of admissible values for the power supply voltage is higher than in the embodiment of FIG. 1, since the dynamic swing in the voltage V5 (terminal BS2) is greater than the dynamic swing of the voltage V4 (terminal BS1) of the device of FIG. 1 which follows the increase in the power supply voltage Vdd leading ultimately to pinch-off of the drain-source voltage of the transistor M3 of the device of FIG. 1.

Indeed, in the embodiment of FIG. 2, when the power supply voltage increases, the voltage V5 increases, but the voltage V4 remains fixed since this voltage drives the gate of an NMOS transistor (the transistor M11) referenced to earth.

By way of indication, whereas the span of possible variations of the power supply voltage Vdd is of the order of 300 millivolts for the device of FIG. 1, it extends between about 0.9 volts and the value of the breakdown voltage of the transistors for the device of FIG. 2.

Moreover, the presence of the second inverter stage ET2 in the device of FIG. 2 allows an increase in the open-loop gain (even if this increase is small given the small gain of the inverter stage), thereby tending in the direction of an improvement in the PSRR parameter.

That said, both the device of FIG. 1 and the device of FIG. 2 exhibit a variable voltage offset between the terminals BE1 and BE2 (on the voltages V1 and V2), because of the non-equality between the drain voltages V3 and V4 of the transistors M3 and M4, this voltage offset being moreover variable with temperature. This may be an impediment in certain applications. Hence, so as to reduce this offset on the voltages V1 and V2, and thus better equalize these voltages V1 and V2, it is for example possible to use the embodiment illustrated in FIG. 3.

Figure 3:
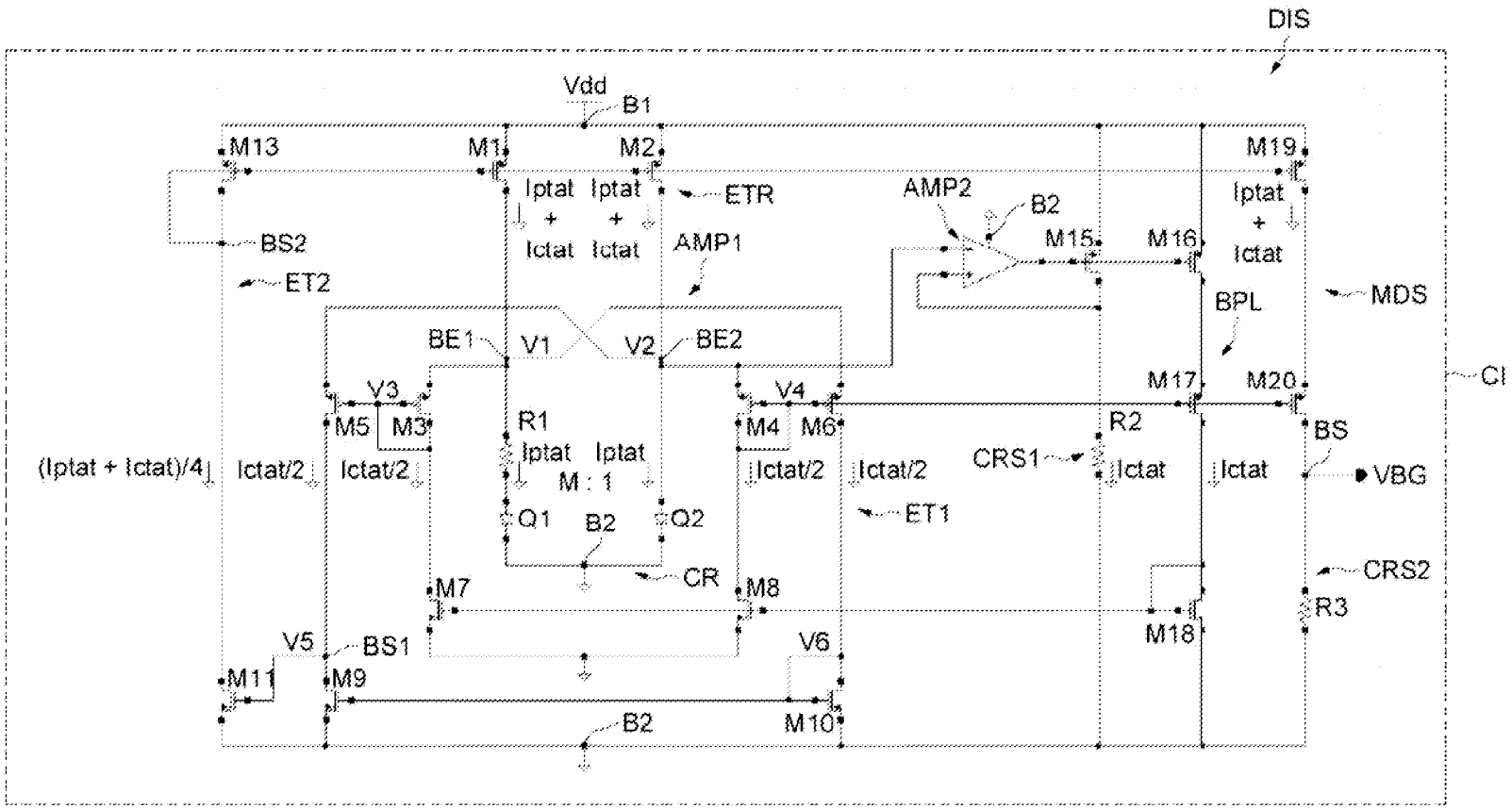

Relative to the previous embodiments, the first stage ET1 of the amplifier AMP of the device DIS illustrated in FIG. 3 has a different structure, but still exhibiting a folded arrangement as a common-gate setup. More precisely, the first stage ET1 comprises a first differential pair of branches connected between the two terminals BE1 and BE2 of the core and the reference terminal B2 (earth), this first differential pair of branches comprising a first pair of first PMOS transistors M3 and M4.

The first stage ET1 moreover comprises a second differential pair of branches connected in a crossed manner between the two terminals BE1 and BE2 of the core, and the reference voltage (terminal B2), this second differential pair of branches comprising a second pair of first PMOS transistors M5 and M6.

The transistors M3 and M4 of the first pair of transistors are mounted in diode fashion, their drain being connected to their gate. Moreover, the gate of the transistor M5 is linked to the gate of the transistor M3 and the gate of the transistor M6 is linked to the gate of the transistor M4. The doublet of homologous transistors M3, M5 of the two pairs therefore forms a pseudo-current mirror, just like the doublet of the homologous transistors M4, M6 of the two pairs.

Each doublet forms a pseudo-current mirror since the sources of the two transistors of each doublet are different. This being so, the equality of the currents flowing in the two transistors of each doublet stems from the fact that the device equalizes the sources of the two corresponding transistors in the steady state, that is to say when the voltages V1 and V2 are equalized or almost equalized. A copied current is then obtained and each doublet of transistors then behaves functionally as a current mirror. Each doublet may therefore be said to form a pseudo-current mirror structurally and a current mirror functionally.

The first differential pair of branches includes the two NMOS bias transistors, referenced M7 and M8, respectively connected in series with the PMOS transistors M3 and M4.

The second differential pair of branches comprises a first supplementary NMOS transistor M9 and a second supplementary transistor M10, the latter being mounted in diode fashion, whose gates are mutually connected, and together forming a current mirror.

The drain of the first supplementary NMOS transistor referenced M9 is connected to the drain of the PMOS transistor M5 and its source is linked to earth (terminal B2). Likewise, the drain of the supplementary NMOS transistor referenced M10 is connected to the drain of the transistor M6 and its source is linked to the terminal B2.

The size (ratio W/L where W denotes the width of the channel and L the length of the channel) of the supplementary NMOS transistor M10 is equal to the size of the first NMOS transistor M11 of the inverter stage ET2 whose gate is connected to the output BS1 of the stage ET1.

Here again, the stage ET1 is, in this embodiment, a differential-input single-output stage while the inverter stage ET2 is, just like in the embodiment of FIG. 2, a single-input single-output stage.

In the embodiment of FIG. 3, the size of the transistor M18 of the bias loop is twice as large as the size of the bias transistors M7 and M8. The bias loop BPL therefore makes it possible to cause a bias current equal to Ictat/2 to flow in the first differential pair of branches comprising the bias transistors M7 and M8.

The pseudo-current mirrors M3, M5, and M4, M6 also make it possible to cause a bias current equal to Ictat/2 to flow in the branches of the second differential pair of branches of the first stage ET1. Consequently, the intermediate current flowing in the feedback stage ETR is still equal to Iptat+Ictat.

On the other hand the size of the transistor M13 of the stage ET2 is here four times smaller than that of the transistors M1 and M2. Therefore a current (Iptat+Ictat)/4 flows in the stage ET2. It is therefore noted that the voltage V5 (drain of the transistor M5) drives the gate of an NMOS transistor, in this instance the transistor M11 of the stage ET2, while the voltage V6 (drain of the transistor M6) also drives the gate of an NMOS transistor, in this instance the transistor M10 of the current mirror M9, M10.

Moreover, since the resistors R1 and R2 have been chosen so as to obtain a version VBG that is independent of temperature, that is to say to obtain a compensation of the linear terms as a function of temperature of the currents Iptat and Ictat, the current Iptat is substantially equal to the current Ictat and consequently the current flowing in the transistor M11 is substantially equal to Ictat/2. And, since the size of the transistors M11 and M10 is identical and these two transistors are traversed substantially by the same current, namely the current Ictat/2, there is quasi-equality of the voltages V5 and V6 and consequently an appreciable reduction in the offset at the level of the voltages V1 and V2.

It should be noted here that the current mirror M9, M10 makes it possible to recover the differential and actually allows a single output for the first stage ET1. Moreover, this embodiment makes it possible to further increase the PSRR parameter because of the crossed coupling of the differential pairs of branches containing the transistors M3, M5, M4, M6 which allow an increase by two in the gain.

That said, because of the presence in the embodiment of FIG. 3 of two gain stages, namely a first gain stage provided by the transistors M5, M9 of the first stage ET1 and a second gain stage provided by the inverter stage ET2 (even if this second gain is small since the transistor M13 is mounted in diode fashion), stability problems may result with the output signal, giving rise to the presence in this signal of sustained oscillations. It may therefore be necessary, in certain applications, to compensate for these oscillations for example through the addition of capacitors.

Figure 4:
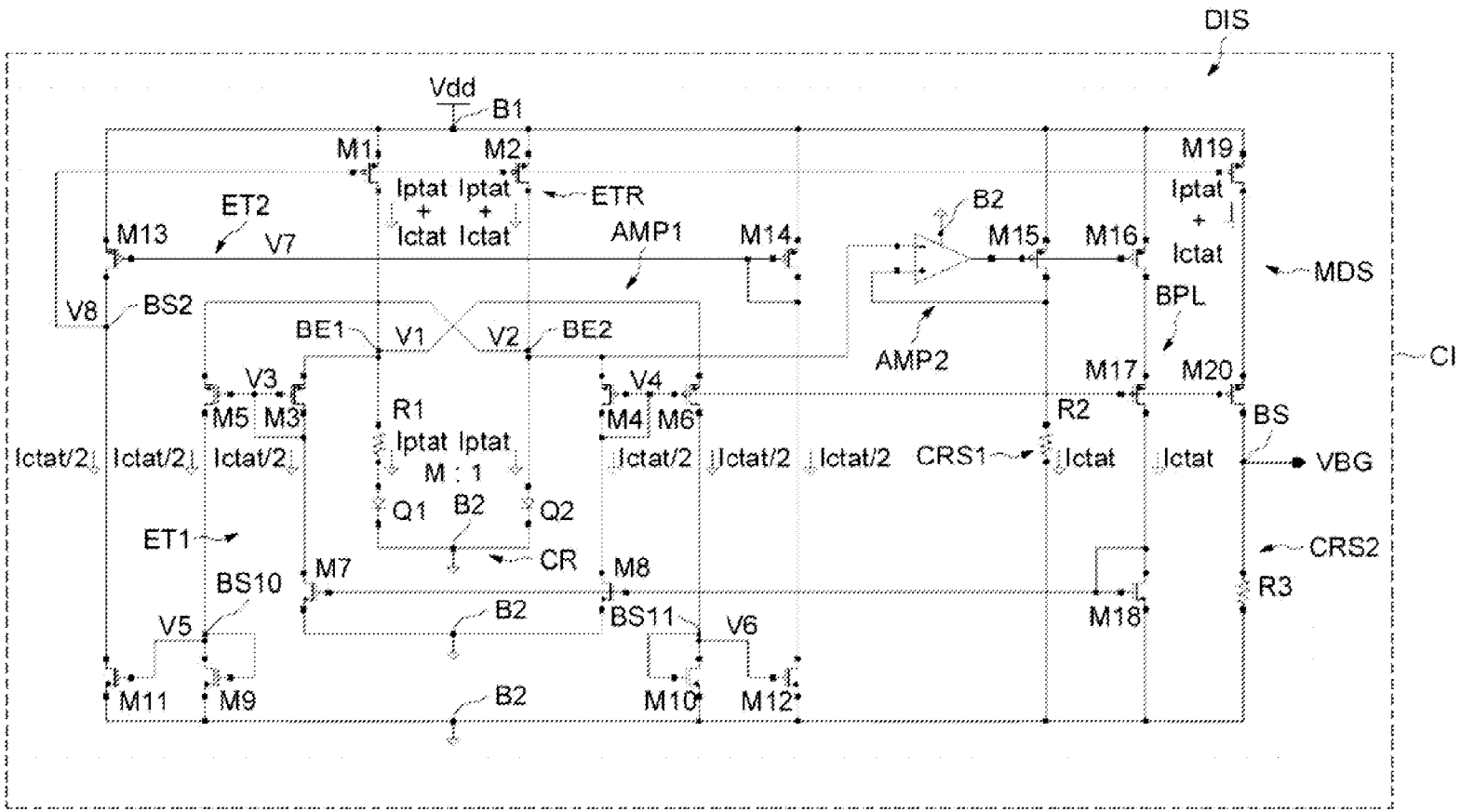

That said, the embodiment of FIG. 4 makes it possible to offer a reduction in or indeed the elimination of the offset between the voltages V1 and V2 while making it possible, in certain applications, to circumvent compensation by addition of capacitors. More precisely, with respect to the embodiment of FIG. 3, this time the first amplifier AMP1 stage ET1 of the device of FIG. 4 comprises, in its second differential pair of branches, not only the second supplementary NMOS transistor M10 mounted in diode fashion, but also the first supplementary NMOS transistor M9 mounted in diode fashion. The first supplementary NMOS transistor M9, mounted in diode fashion, forms with the NMOS transistor M11 of the inverter stage ET2, whose gate is linked to the drain of the transistor M9, a current mirror.

Moreover, in this embodiment, the inverter stage ET2 comprises a second branch comprising a second NMOS transistor M12 and a second PMOS transistor M14 mounted in diode fashion, connected in series between the power supply terminal B1 and the second NMOS transistor M12 referenced moreover to earth (connection of the source to the terminal B2).

The gate of the PMOS transistor M14 is moreover linked to the gate of the PMOS transistor M13 of the stage ET2, these two transistors M13 and M14 thus forming a current mirror. The size of the transistors M13 and M14 is identical and is four times smaller than the size of the transistors M1, M2. By analogy with the transistors M9 and M11, the transistors M10 and M12 form an NMOS current mirror, the gate of the transistor M12 being linked to the drain of the transistor M10.

It will also be noted here that this time the stage ET1 is a differential-input differential-output stage, the differential output BS10-BS11 of the first stage ET1 being formed by the drains of the transistors M5 and M6. Therefore, this time the inverter stage ET2 is a differential-input single-output stage.

Moreover, it will be noted here that the gain of the inverter stage ET2 is much greater than the gain of the stage ET2 of the previous embodiments since this time the transistor M13 is not mounted in diode fashion.

The current Ictat/2 flows in the first differential pair of branches by virtue of the bias loop BPL comprising the bias NMOS transistors M7 and M8. The pseudo-current mirrors M3, M5 on the one hand, and M4, M6 on the other hand, also allow flow of the current Ictat/2 in the second differential pair of branches.

The current mirrors M9, M11 on the one hand and the current mirrors M10, M12 on the other hand allow, for their part, flow of the current Ictat/2 in the two branches M11, M13 and M12, M14 of the inverter stage ET2.

Relative to the previous embodiment, there is a still greater reduction in the voltage offset at the level of the voltages V1 and V2 because of the equality of the voltages V5 and V6. Indeed, these two voltages V5 and V6 drive respectively two NMOS transistors of identical size, M9 and M10, mounted in diode fashion, this time traversed by one and the same current Ictat/2. An offset still persists on account of the inequality between the voltages V7 and V8, but its impact is divided by the gain of the stage ET2 (M11-M13).

Moreover, this time the current mirror M13, M14 makes it possible to recover the differential at the level of the inverter stage ET2 which is a stage with single output BS2.

Furthermore, the stability of the output signal of the device of FIG. 4 is much greater and it is therefore possible to circumvent compensation. Indeed, even if the transistors M5 and M9 and also M6 and M10 form a gain stage, this gain is tiny given the fact that the transistors M9 and M10 are mounted in diode fashion. Consequently, here the structure of FIG. 4 may be considered to comprise essentially a single gain stage, namely that provided by the transistors M13 and M11 as well as M12 and M14 of the stage ET2, thereby favouring the stability of the output signal. Indeed the high-impedance node BS2 (voltage V8) is situated just where the capacitive value is the highest so as to form a first low-frequency pole which favours stability.

Figure 5:
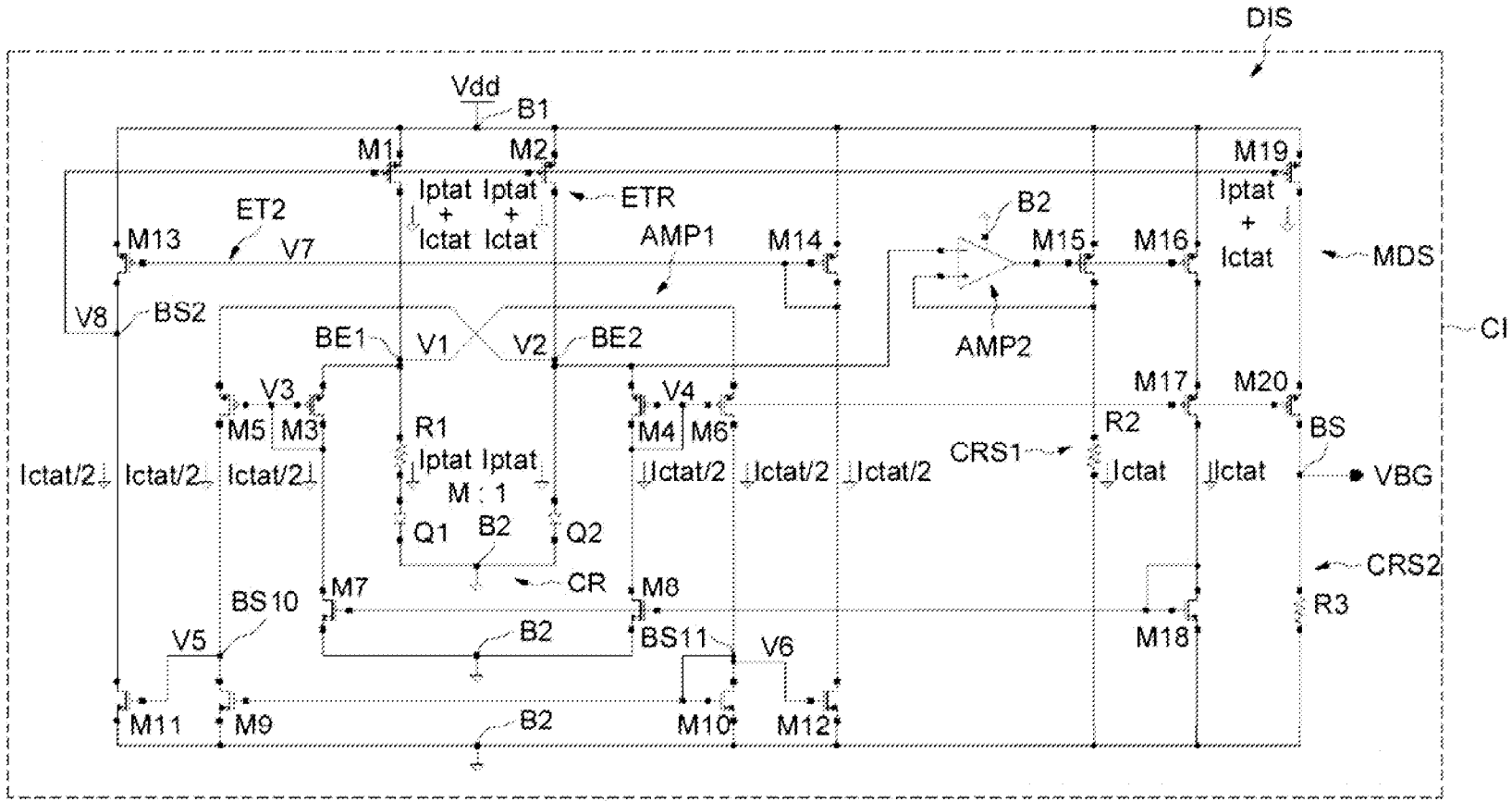

The embodiment of FIG. 5 makes it possible, as will be seen in greater detail hereinafter, to increase the gain of the structure as well as the PSRR parameter while continuing to offer a greater span of values for the power supply voltage, and a still greater reduction in the offset between the voltages V1 and V2. In this regard, the device DIS of FIG. 5 comprises an amplifier AMP1 whose first stage ET1 has a structure identical to that of the first stage ET1 of the amplifier of FIG. 3, and whose stage ET2 has the same structure as that of the stage ET2 of the amplifier of FIG. 4.

Consequently, relative to the structure of FIG. 4, the gain is greatly increased since here two gain stages are present, namely that produced by the transistors M3 to M10 of the stage ET1, and by the transistors M11, M12, M13 and M14 of the stage ET2. On account of the increase in the gain, the PSRR parameter is increased.

Moreover, in a manner analogous to what was explained hereinabove, the span of admissible values for the power supply voltage is considerable because of the considerable dynamic swing of the voltage V5 while the voltage V4 remains fixed when the power supply voltage varies.

Moreover, as was explained hereinabove, here there is still a considerable reduction in the voltage offset between the voltages V1 and V2 because of the equality of the voltages V5 and V6, both of which drive MOS transistors of identical size traversed by one and the same current, namely the current Ictat/2.

Moreover, the impact of the offset between the voltages V7 and V8 is further minimized because of the greater gain of the stage ET2.

By way of indication, the value of the gain of such a structure is of the order of 80 dB with a PSRR parameter of the order of 120 dB in the steady state (under DC: "Direct Current"). The power supply voltage can vary between about 0.9 volts and the value of the breakdown voltage of the transistors.

On the other hand, in certain applications such a structure may require compensation because of the presence of the two gain stages if the capacitive value at the level of the gates of the transistors M1 and M2 is not sufficient. This compensation may be carried out between the voltages V8 and V5 or else between the power supply voltage Vdd and the voltage V8. That said, the compensation may be readily carried out by placing for example a capacitor between the voltage V5 and V8, that is to say between the drain of the transistor M5 and the drain of the transistor M11, and in this regard the Miller effect is of benefit, the latter making it possible to have an effective capacitance between the voltage V5 and earth equal to the product of the capacitive value of the capacitor and the gain of the stage ET2. The Miller effect also makes it possible to push the $2^{nd}$ pole off to high frequency.

What is claimed is:

1. A circuit comprising:

a power supply terminal;

a ground terminal;

a first circuit configured to generate a current proportional to absolute temperature, the first circuit comprising a first processing circuit connected to terminals of a core circuit and configured to equalize voltage across the terminals of the core circuit, the first processing circuit comprising:

a first amplifier having a first stage, biased based on a current inversely proportional to absolute temperature, comprising first PMOS transistors having conduction paths between the terminals of the core circuit and the ground terminal and having a common-gate connection; and a feedback stage having an input connected to an output of the first amplifier and having an output connected to the input of the first stage and to a terminal of the core, the feedback stage being configured to be traversed by an intermediate current equal to the sum of the current proportional to absolute temperature and of the current inversely proportional to absolute temperature;

a second circuit configured to generate the current inversely proportional to absolute temperature, wherein the second circuit includes a follower amplifier setup connected to a terminal of the core and separated from the first amplifier, the follower amplifier comprising a second amplifier and a feedback transistor connected between the output of the second amplifier and an input of the second amplifier;

an output module connected to the feedback stage and configured to output a reference voltage; and wherein a bias loop is connected between the second circuit and the first stage of the first amplifier, and is configured to bias the first stage based on the current inversely proportional to absolute temperature, the bias loop is configured to cause a flow, in the first PMOS transistors, of a bias current drawn from the current inversely proportional to absolute temperature, and the feedback stage is configured to be traversed by the intermediate current that is the sum of the current proportional to absolute temperature and of the bias current flowing in the first PMOS transistors.

2. The circuit according to claim 1, wherein the first amplifier is a differential-input single-output amplifier and the feedback stage is a single-input differential-output feedback stage.

3. A device for generating an adjustable bandgap reference voltage, the device comprising:

a first circuit configured to generate a current proportional to absolute temperature, the first circuit comprising a first processing circuit connected to terminals of a core and configured to equalize the voltages across the terminals of the core, wherein the first processing circuit comprises a first amplifier having at least one first stage, biased on the current inversely proportional to absolute temperature, arranged according to a folded setup and comprising first PMOS transistors arranged according to a common-gate setup, and a feedback stage with an input connected to an output of the first amplifier and an output connected to an input of the first stage as well as to at least one terminal of the core;

a second circuit connected to the core and configured to generate a current inversely proportional to absolute temperature, the second circuit comprising a follower amplifier setup connected to a terminal of the core and separated from the first amplifier;

an output module connected to the feedback stage and configured to generate the reference voltage;

a bias loop connected between the second circuit and the first stage of the first amplifier, wherein the bias loop is configured to bias the first stage based on the current inversely proportional to absolute temperature;

wherein the first stage comprises at least one differential pair of branches connected between the terminals of the core and a reference voltage, and the bias loop is configured to cause a flow, in each differential pair of branches, of a bias current drawn from the current inversely proportional to absolute temperature, and wherein the feedback stage is configured to be traversed by an intermediate current that is the sum of the current proportional to absolute temperature and of each bias current flowing in each differential pair of branches; and wherein the follower amplifier setup comprises a second amplifier and a feedback transistor connected between the output of the second amplifier and an input of the second amplifier, the second circuit furthermore comprises a first resistive circuit connected in series with the feedback transistor, the first stage comprises, within a differential pair of branches, a pair of NMOS bias transistors connected in series with a pair of first PMOS transistors, and the bias loop comprises the feedback transistor, a first additional transistor forming with the feedback transistor a first current-copying circuit, and the pair of NMOS bias transistors, wherein the bias loop is configured to cause the flow, in each differential pair of branches, of a bias current equal to the current inversely proportional to absolute temperature or to a fraction of the current inversely proportional to absolute temperature.

4. The device according to claim 3, wherein the feedback stage comprises a pair of second PMOS transistors mutually connected by their gate, wherein respective sources of the second PMOS transistors are connected to a power supply terminal and drains of the second PMOS transistors are respectively linked to the terminals of the core, and the output module comprises a second resistive circuit comprising a second additional PMOS transistor forming, with the second PMOS transistors of the feedback stage, second copying means configured to deliver in the second resistive circuit a copied current equal to the intermediate current or a multiple or sub-multiple of the intermediate current.

5. The device according to claim 4, furthermore comprising a first auxiliary transistor forming with the first additional transistor a first cascode setup and a second auxiliary transistor forming with the second additional PMOS transistor of the second resistive circuit a second cascode setup.

6. The device according to claim 3, wherein the first amplifier comprises an inverter stage arranged in a setup according to a common-source type, and connected between the output of the first stage and the input of the feedback stage, the output of the inverter stage forming the output of the amplifier.

7. The device according to claim 6, wherein the first stage of the first amplifier comprises a first differential pair of branches connected between the terminals of the core and a reference voltage and comprising a first pair of first PMOS transistors, and a second differential pair of branches connected in a crossed manner between the terminals of the core and the reference voltage and comprising a second pair of first PMOS transistors, wherein the first pair of first PMOS transistors and the second pair of first PMOS transistors comprise two doublets of homologous transistors that form respectively two pseudo-current mirrors, and wherein drains of the second pair of first PMOS transistors are respectively connected to gates of two NMOS bias transistors of a same size and intended to be traversed by two substantially equal currents.

8. The device according to claim 7, wherein the first pair of first PMOS transistors of the first differential pair are mounted in diode fashion and the drains of the first pair of first PMOS transistors are respectively connected to the reference voltage by way of the two NMOS bias transistors, the drain of one of the second pair of first PMOS transistors of the second differential pair is connected to the gate of a first NMOS transistor of the inverter stage and also connected to the reference voltage by way of a first supplementary NMOS transistor, and the drain of the other of the second pair of first PMOS transistors of the second differential pair is connected to the reference voltage by way of a second supplementary NMOS transistor mounted in diode fashion.

9. The device according to claim 8, wherein the inverter stage comprises a first branch comprising the first NMOS transistor and a first PMOS transistor connected in series between the first NMOS transistor and a power supply terminal, and a second branch comprising a second NMOS transistor and a second PMOS transistor, mounted in diode fashion, connected in series between the power supply terminal and the second NMOS transistor, the first PMOS transistor and the second PMOS transistor being mutually arranged in current mirror fashion, the first supplementary NMOS transistor is mounted in diode fashion and forms with the first NMOS transistor of the inverter stage a first current mirror, and the drain of the other of the two first PMOS transistors of the second differential pair is also connected to the gate of the second NMOS transistor of the second branch of the inverter stage.

10. The device according to claim 8, wherein the first supplementary NMOS transistor and the second supplementary NMOS transistor, which is mounted in diode fashion, are mutually arranged in current mirror fashion.

11. The device according to claim 10, wherein the inverter stage comprises a first branch comprising the first NMOS transistor and a first PMOS transistor connected in series between the first NMOS transistor and a power supply terminal and a second branch comprising a second NMOS transistor and a second PMOS transistor, mounted in diode fashion, connected in series between the power supply terminal and the second NMOS transistor, the first PMOS transistor and the second PMOS transistor being mutually arranged in current mirror fashion, the drain of the other of the two first PMOS transistors of the second differential pair is also connected to the gate of the second NMOS transistor of the second branch of the inverter stage.

12. An integrated circuit comprising:

a power voltage terminal;

a ground terminal;

an adjustable bandgap reference voltage generator, coupled between the power voltage terminal and the ground terminal and including:

a core circuit;

a first circuit configured to generate a current proportional to absolute temperature, the first circuit configured to equalize voltages across terminals of the core circuit, the first circuit including a first amplifier possessing at least one first stage, biased in response to a current inversely proportional to absolute temperature, the at least one first stage arranged according to a folded setup and comprising first PMOS transistors arranged according to a common-gate setup, and a feedback stage having an input connected to an output of the first amplifier and having an output connected to an input of the first stage and to at least one terminal of the core;

a second circuit configured to generate the current inversely proportional to absolute temperature, the second circuit comprising a follower amplifier connected to a terminal of the core and separated from the first amplifier;

an output module, connected to the feedback stage, and configured to output the bandgap reference voltage;

a bias loop connected between the second circuit and the first stage of the first amplifier, wherein the bias loop is configured to bias the first stage based on the current inversely proportional to absolute temperature; and wherein the first stage comprises at least one differential pair of branches having conduction paths between the terminals of the core and the ground terminal, and the bias loop is configured to cause a flow, in each differential pair of branches, of a bias current drawn from the current inversely proportional to absolute temperature, and wherein the feedback stage is configured to be traversed by an intermediate current that is the sum of the current proportional to absolute temperature and of each bias current flowing in each differential pair of branches.

13. The integrated circuit of claim 12 further comprising a logic circuit configured to receive the bandgap reference voltage.

14. The integrated circuit of claim 12 wherein the first amplifier is a differential-input single-output amplifier and the feedback stage is a single-input differential-output feedback stage.

15. The integrated circuit according to claim 12, wherein the follower amplifier comprises a second amplifier and a feedback transistor connected between the output of the second amplifier and an input of the second amplifier, the second circuit furthermore comprise a first resistive circuit connected in series with the feedback transistor, the first stage comprises, within a differential pair of branches, a pair of NMOS bias transistors connected in series with a pair of first PMOS transistors, and the bias loop comprises the feedback transistor, a first additional transistor forming with the feedback transistor a first current-copying circuit, and the pair of NMOS bias transistors, wherein the bias loop is configured to cause the flow, in each differential pair of branches, of a bias current equal to the current inversely proportional to absolute temperature or to a fraction of this current inversely proportional to absolute temperature.

16. The integrated circuit according to claim 15, wherein the feedback stage comprises a pair of second PMOS transistors mutually connected by their gate, wherein respective sources of the second PMOS transistors are connected to a power supply terminal and drains of the second PMOS transistors are respectively linked to the terminals of the core, and the output module comprises a second resistive circuit comprising a second additional PMOS transistor forming, with the second PMOS transistors of the feedback stage, a second current-copying circuit configured to deliver in the second resistive circuit a copied current equal to the intermediate current or a multiple or submultiple of the intermediate current.

* * * * *